US006276461B1

(12) United States Patent
Stager

(10) Patent No.: US 6,276,461 B1
(45) Date of Patent: Aug. 21, 2001

(54) FIRE EXTINGUISHER FOR STOVE GREASE FIRE AND MOUNT THEREFOR

(76) Inventor: Daniel J. Stager, 1100 Sweitzer St., Greenville, OH (US) 45331

( * ) Notice: Subject to any disclaimer, the term of this patent is extended or adjusted under 35 U.S.C. 154(b) by 0 days.

(21) Appl. No.: 09/614,469

(22) Filed: Jul. 11, 2000

Related U.S. Application Data

(63) Continuation-in-part of application No. 09/289,923, filed on Apr. 12, 1999, now Pat. No. 6,105,677.

(60) Provisional application No. 60/084,547, filed on May 7, 1998.

(51) Int. Cl.[7] ..... A62C 25/00; A62C 35/02; A62C 37/12

(52) U.S. Cl. ..... 169/65; 169/26; 169/52; 169/57

(58) Field of Search ..... 169/26, 42, 51, 169/52, 54, 65, DIG. 3, 57; 248/201, 202.1

(56) References Cited

U.S. PATENT DOCUMENTS

| | | | | |
|---|---|---|---|---|
| 1,063,228 | * | 6/1913 | Thornton | 169/26 |
| 3,209,837 | * | 10/1965 | Freedman | 169/65 |
| 3,918,526 | * | 11/1975 | Hattori et al. | 159/65 X |
| 5,063,998 | * | 11/1991 | Quinn | 169/65 |
| 5,355,026 | * | 10/1994 | Scofield | 169/65 X |
| 5,518,075 | * | 5/1996 | Williams | 169/65 X |
| 5,868,205 | * | 2/1999 | Cunningham et al. | 169/26 X |

* cited by examiner

*Primary Examiner*—Steven J. Ganey
(74) *Attorney, Agent, or Firm*—William Weigl

(57) ABSTRACT

Two embodiments of a swing-down type fire extinguisher are disclosed. In one embodiment, a single unit can extinguish either or both of two fires on a stove having front and back burners. This is accomplished by dispensing fire suppressant material toward both burners in the initial motion of swinging down upon activation by a fire and continuing with a pendulum action designed to distribute material to both the front burner and a back burner aligned in the direction of swinging. In a second embodiment, a single unit is provided for each burner. It is operated in two stages, first to respond to a fire or flame by unlatching the extinguisher to release from a horizontal inoperative or "at rest" position and enabling it to swing down to a fire extinguishing position directly over the pan with the burning grease. In the second stage, almost instantaneously after reaching the vertical position over a pan, a heat or flame responsive release mechanism enables dispensing of the material directly downwardly with a combined gravitational and spring force as a closure for the unit opens. The spring has one end anchored in the unit and its free end is designed to provide a slight orbital oscillation to assist in laterally distributing the material about the cooking vessel during dispensing. Also provided is a novel mounting structure in the form of a pair of parallel spring-loaded telescoping rods, for enabling the extinguisher to be installed and removed without the use of tools.

18 Claims, 4 Drawing Sheets

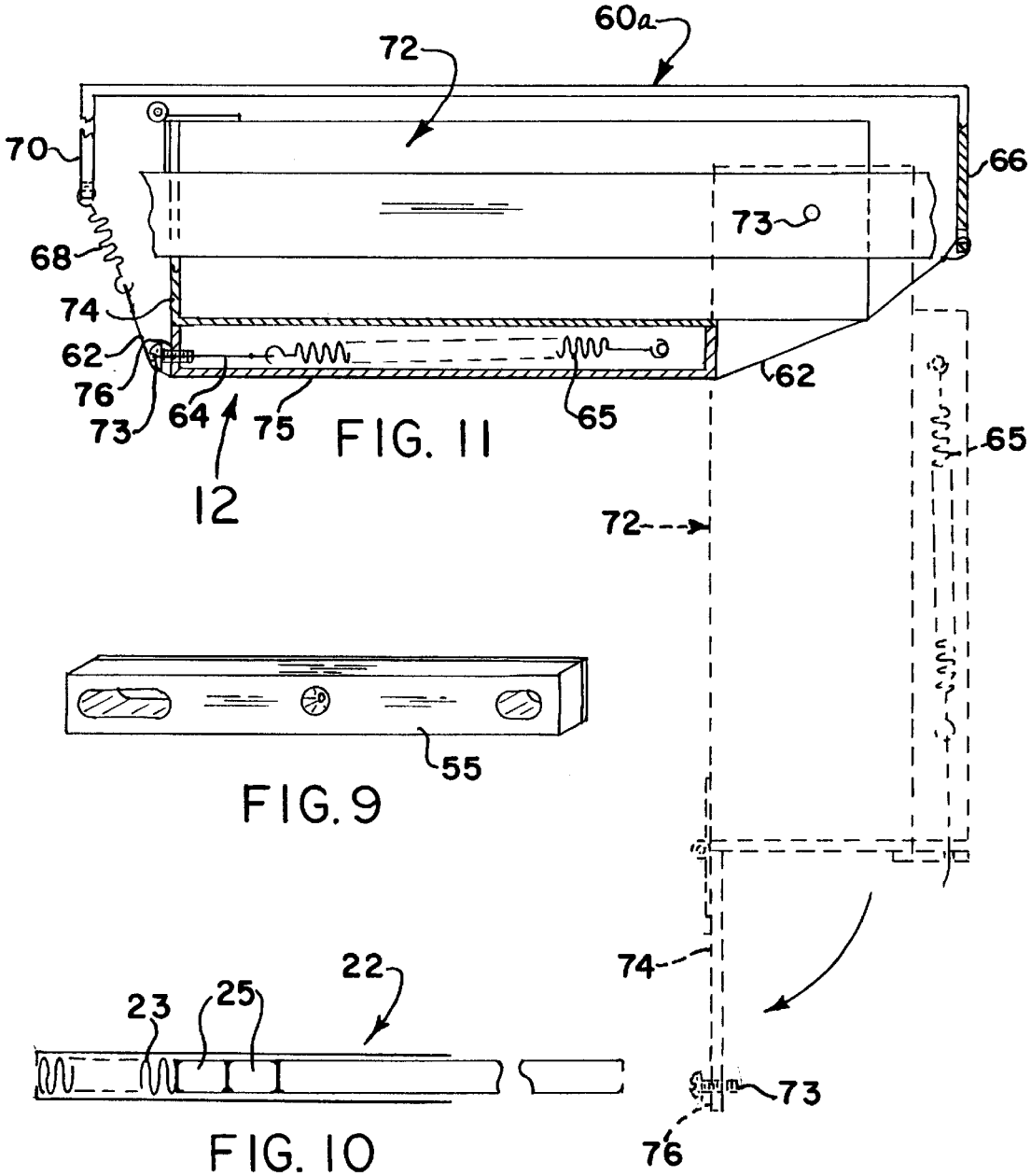
FIG. 11
FIG. 9
FIG. 10
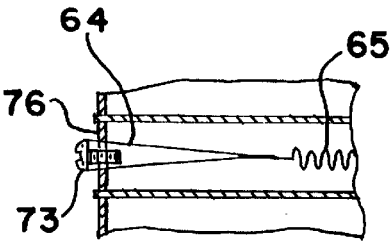
FIG. 12
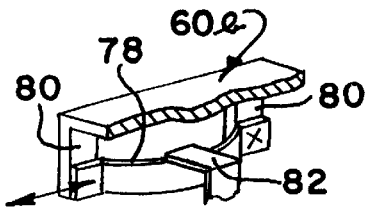
FIG. 14
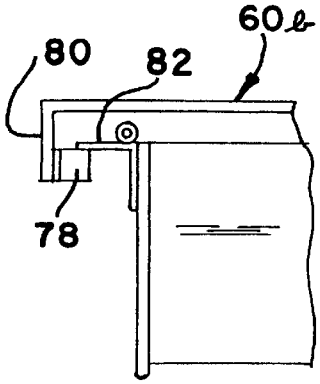
FIG. 13

FIRE EXTINGUISHER FOR STOVE GREASE FIRE AND MOUNT THEREFOR

This application is a continuation-in-part of U.S. patent application Ser. No. 09/289,923, filed Apr. 12, 1999, now U.S. Pat. No. 6,105,677, which claims benefit of Ser. No. 60/084,547 filed May 7, 1998.

This invention relates to a device for extinguishing a stovetop grease fire and to its means for mounting the device beneath the hood of a stove.

BACKGROUND OF THE INVENTION

Grease fires originating at a cooking stove are well documented as a major cause of serious home fires. Insurance companies can testify to the dangers posed by fires originating from overheating and ignition of grease or oil during cooking. Many solutions have been proposed for extinguishing stove grease fires, but none prior to my above parent patent appears to have demonstrated the necessary effectiveness to put out such a fire and keep it out in the event the burner remains active after the fire has been extinguished. In the panic that usually ensues when a grease fire occurs, turning off the gas or electric burner is frequently overlooked, since greatest focus is on what to do about putting out the fire. Assuming a typical hand-held extinguisher is available and is used to cause the flame to die out, the grease can reignite if the burner is still on and the cooking utensil remains on the burner. If a one-shot extinguisher is mounted on the stove, it is no longer effective, having been spent in the initial flame-up. The most effective method of preventing reignition is to flood the cooking vessel with sufficient fire suppressant powder to cause the oil or grease to cake and solidify, as discussed in my aforementioned patent. That will prevent a second flare-up.

In contrast to extensively-used relatively inexpensive smoke alarms that are fairly simple for an average homeowner to install, stovetop fire extinguishers are believed to be only nominally used at the present time. They are either too complex for the average homeowner to install, are too cumbersome and bulky due to having to use activating cables extending around and above the cooking area, do not adequately fit above the cooking area without inconveniencing the cooking operation, are required to be mounted inside a relatively inaccessible cooking hood or are so costly that they are unaffordable to those persons at the lower end of the economic scale, the very persons who may have greatest need for an extinguisher.

SUMMARY OF THE INVENTION

Two embodiments of a swing-down type fire extinguisher are disclosed. In one embodiment, a single unit can extinguish either or both of two fires on a stove having front and back burners. This is accomplished by dispensing fire suppressant material toward both burners in the initial motion of swinging down upon activation by a fire and continuing with a pendulum action designed to distribute material to both the front burner and a back burner aligned in the direction of swinging. In a second embodiment, a single unit is provided for each burner. It is operated in two stages, first to respond to the heat or flame of a fire by unlatching the extinguisher to release from a horizontal inoperative or "at rest" position and enabling it to swing down to a fire extinguishing position directly over the pan with the burning grease. In the second stage, almost instantaneously after reaching the vertical position over a pan, a heat or flame responsive release mechanism enables dispensing of the material directly downwardly with a combined gravitational and spring force as a closure for the unit opens. The spring has one end anchored in the unit and its free end is designed to provide a slight orbital oscillation to assist in laterally distributing the material about the cooking vessel during dispensing.

Also provided is a novel mounting means in the form of a pair of parallel spring-loaded rods, for enabling the extinguisher to be installed and removed without the use of tools.

One principal object of the invention is to provide an elongated stovetop grease fire extinguisher that is mounted horizontally on the underside of a range hood and which swings down to a vertical position when called upon to dispense fire suppressant material in response to existence of a fire.

Ancillary thereto in one version of the apparatus of the invention is to provide a pendulum-type swinging action to the extinguisher when moving to and while in the active dispensing position, whereby to extinguish a grease fire at either of two closely-positioned burner locations that are aligned essentially with the pendulum swinging direction.

A second primary object of the invention is to provide an oscillating downwardly-extending spring for assisting in ejection of a fire suppressant powder and spreading it evenly over an area larger than the cross-sectional dimension of the extinguisher barrel, whereby a small diameter container can cover a large grease-containing pan or pans.

A still further object is to provide a support for a stovetop fire extinguisher which enables easy removal and replacement of an extinguisher without the use of tools and which has no connections to outside sources of power to activate the extinguishing function.

Another object is to provide a mounting structure for a stovetop fire extinguisher that enables installation and removal by simple compression of a pair of spring-loaded rods.

Other objects and advantages will become apparent from the following description, in which reference is made to the accompanying drawings.

BRIEF DESCRIPTION OF THE DRAWINGS

FIG. 9 is an enlarged isometric view of a mounting plate for receiving a pair of rods which support the extinguisher over the stove.

FIG. 10 is an enlarged simplified view of a portion of one of the telescoping, expandable rods used to mount the extinguisher in the plate or plates of FIG. 9.

FIG. 11 is a side elevational view of a second embodiment of my extinguisher.

FIG. 12 is a fragmentary bottom view looking upwardly at the left end of FIG. 11.

FIGS. 13 and 14 are views of a variation in the design of the unit of FIGS. 11 and 12, wherein a bimetal strip can be used as an element of a latch for maintaining the unit in its inoperative horizontal position.

DESCRIPTION OF THE PREFERRED EMBODIMENTS

Figure 1:
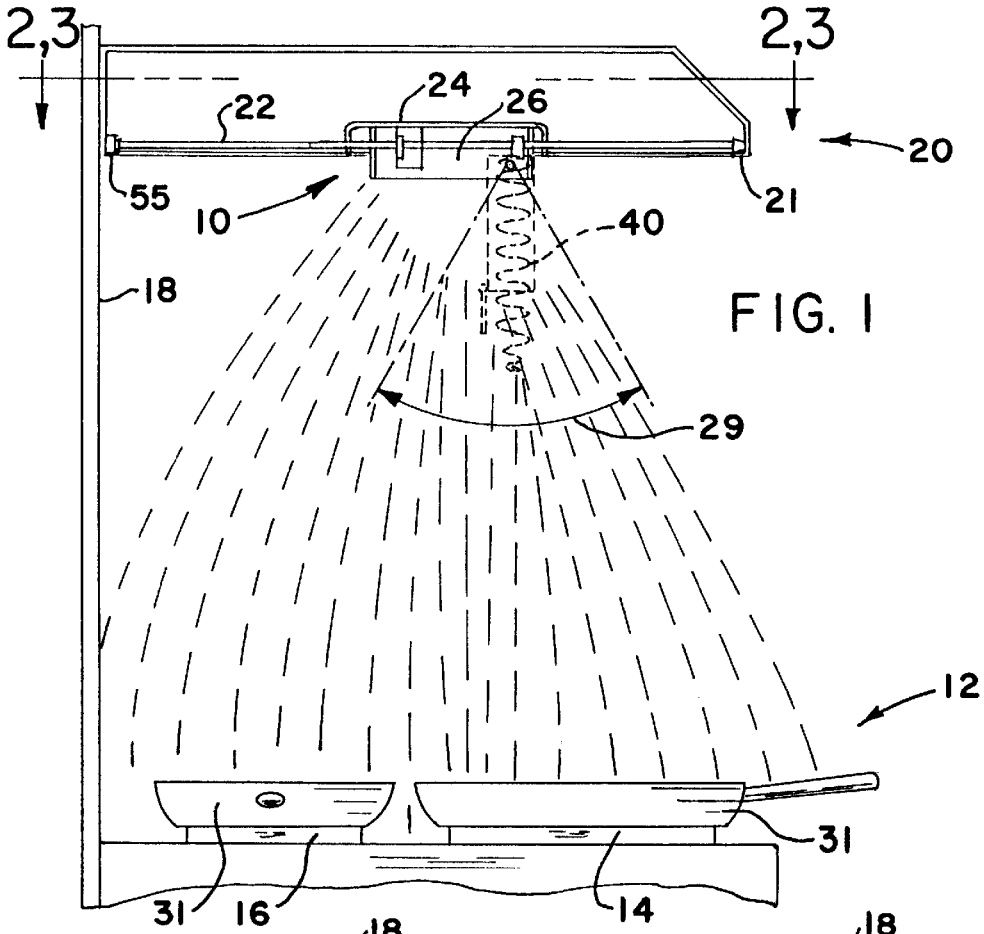
FIG. 1 is simplified side elevational view of a stove having a hood containing a preferred embodiment of my extinguisher, illustrating the manner of using a single unit to accommodate two aligned burners.
Figure 2:
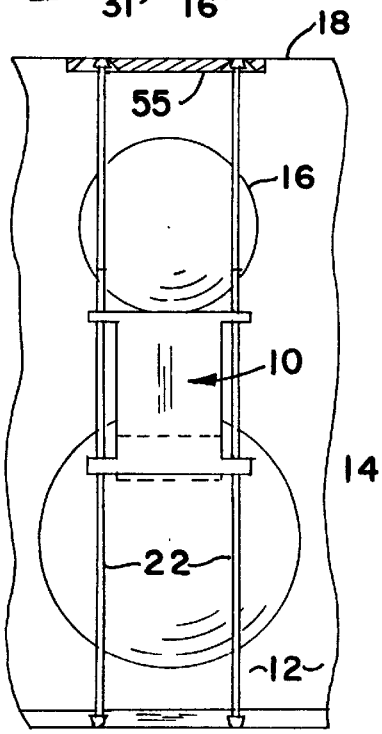
FIGS. 2 and 3 are plan views taken essentially along line 2,3 of FIG. 1, illustrating the different positions of the burners on different stoves and the extinguisher mounting arrangement for the fire extinguisher to accommodate each different type of stove.
Figure 3:
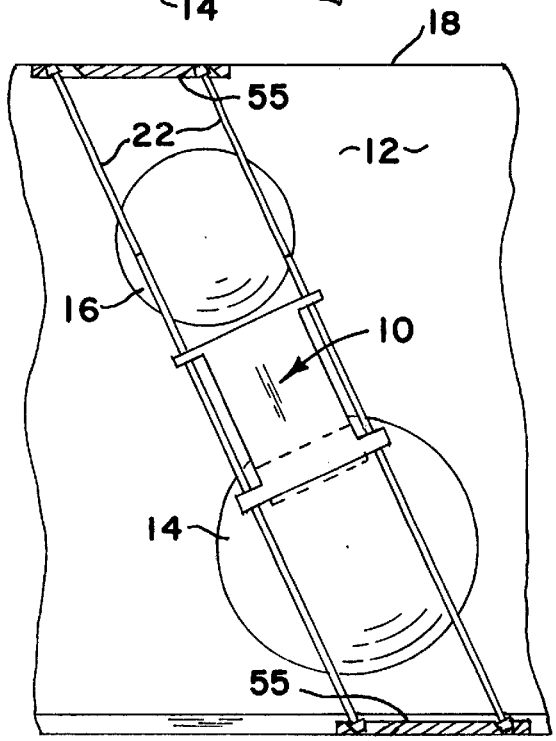

The environment in which my fire extinguisher 10 is designed to be used is in connection with a kitchen stove 12, which may have either gas or electric burners 14 and 16 as shown in FIGS. 1–3. The stove ordinarily abuts against a wall 18, but may be free-standing. While I will describe the invention in connection with a domestic or home situation, it should be understood that it is applicable to any stovetop arrangement, domestic or commercial.

A domestic unit is ordinarily provided with a hood 20 over the stove. Such a hood typically has an exhaust fan and filters (not shown) that in some hood designs may create some difficulty in mounting the extinguisher. For that reason, as will be noted later, the extinguisher 10 may be mounted at any of two or more levels, depending on the particular hood design. Many hoods 20 have an inwardly-directed lip 21, which, as will also be discussed later, makes for convenient mounting of the extinguisher. The extinguisher 10 is supported at the underside of the hood 20 by a pair of spring-loaded telescoping rods 22 shown in greater cross-sectional detail in FIGS. 4 and 10. Each rod is a typical small diameter rod slidable within a larger diameter rod, with an outwardly directed force being provided by a compression spring 23. Because depths of different stoves may vary, and also because of the different length rods needed for the two mounting arrangements depicted in FIGS. 2 and 3, the smallest diameter rods may have an appropriate amount or length of spacers 25 between their inner ends and the springs 23. The spacers 25 may be provided in a kit as a single length rod with snap-off indentations to obtain the correct length needed, or can be a plurality of independent short spacer sections stacked within the larger diameter rod.

Figure 4:
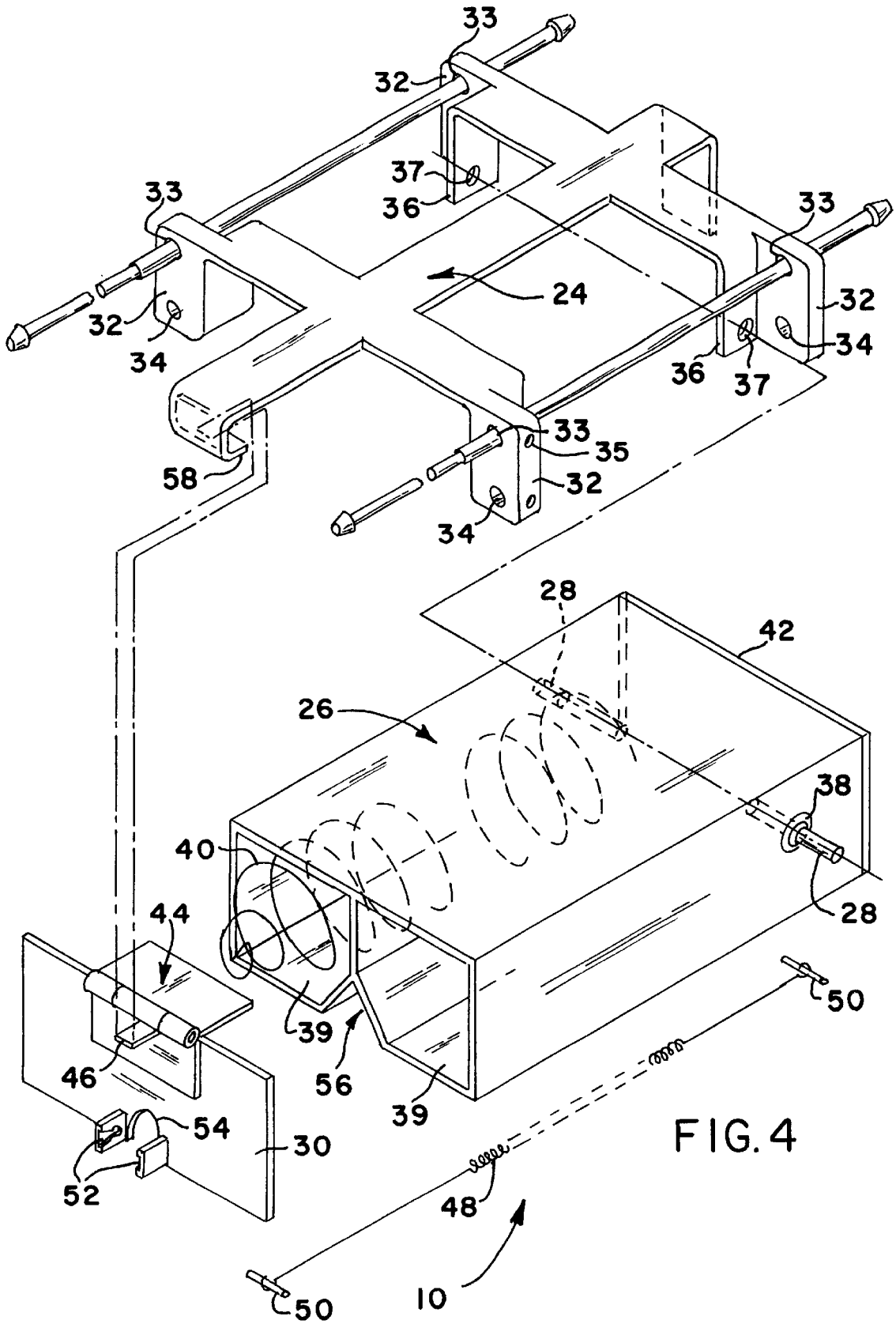
FIG. 4 is an exploded isometric view of a preferred form of fire extinguisher, certain parts being omitted for reasons of clarity.
Figure 8:
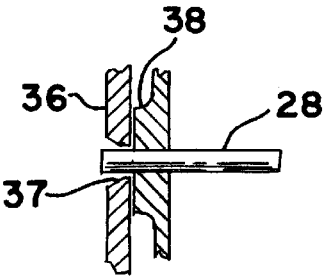
FIG. 8 is an enlarged fragmentary cross-sectional view of one of the pair of trunnions for pivotally mounting the container.

Referring now to FIG. 4, the key elements of the preferred form of extinguisher 10 and its mount includes a primary horizontal bracket 24 which supports a container 26 in a horizontal inoperative position until the heat of a fire releases the extinguisher and enables it to pivot toward and to a vertical operative position about opposed trunions 28. As it swings downwardly, a door or cap 30 opens and fire suppressant powder of any common grease fire extinguishing type that is located in the container 26 is dispensed onto an oil or grease fire in either or both of pans 31 in FIG. 1. As shown in dotted lines in FIG. 1, initial swinging movement of the extinguisher 10 casts powder toward the wall 18 and the back burner 16, then the unit swings in a pendulum-type motion as shown by the arrow 29 until it comes to rest. In actual tests, the dispensing is rapid and the fire is extinguished before the container pendulum action comes to rest. The trunions and their journals may be of any convenient design to allow for free swinging, one such minimized-friction design being illustrated in FIG. 8.

The relationship of the key components can best be noted in FIG. 4 to demonstrate how the extinguisher 10 is freed from its "at rest" or inoperative position and enabled to swing down to dispense material onto the flaming oil or grease in a pan 31. The bracket 24 has depending legs in the form of bracket extensions 32. Each of these extensions 32 is provided with an upper hole 33 and a lower hole 34, one pair of each on opposite sides of the extinguisher. Either set of holes 33 or 34 is designed to receive the rods 22 depending on the preferred height of the container within the hood 20. In some instances, an obstructing filter may require that the container be lower and the rods 22 positioned in the holes 33. If no obstruction is present, the rods are passed through lower holes 34 to raise the extinguisher 10 up in the hood as far as possible for appearance purposes. A large diameter section of each telescoping rod 22 may be held firm in the desired position over the burners 14 and 16 relative to the bracket 24 by a set screw 35.

Bracket 24 and container 26 may be made of any material, and are preferably made of a thermosetting plastic that is suitable for this particular environment. Legs 36 depend downwardly from the bracket 24 at the end of the bracket adjacent the front of the stove 12. These legs are provided with minimal friction journaling holes 37 for receiving the trunnions 28. For stability of the trunnions, the walls of the container may be widened by providing bosses 38 shown in FIGS. 4–7 if desired.

The container 26 is preferably provided with two chambers 39, in each of which the powder is stored. Also located in each chamber is a floppy helical compression spring 40, the purposes of which will become apparent shortly. The chambers 39 are closed at one end with a plate 42 which may be integral with the chambers or attached thereto by any appropriate means, depending on the material of which the container is made. The springs 40 are anchored at one end in the chambers 39 by screwing them over internal ends of the trunnions 28, while the other ends are free to expand outwardly of the chambers when unrestrained. While the amount of expansion is not critical, I prefer that they expand at least 30% of their length.

Figure 5:
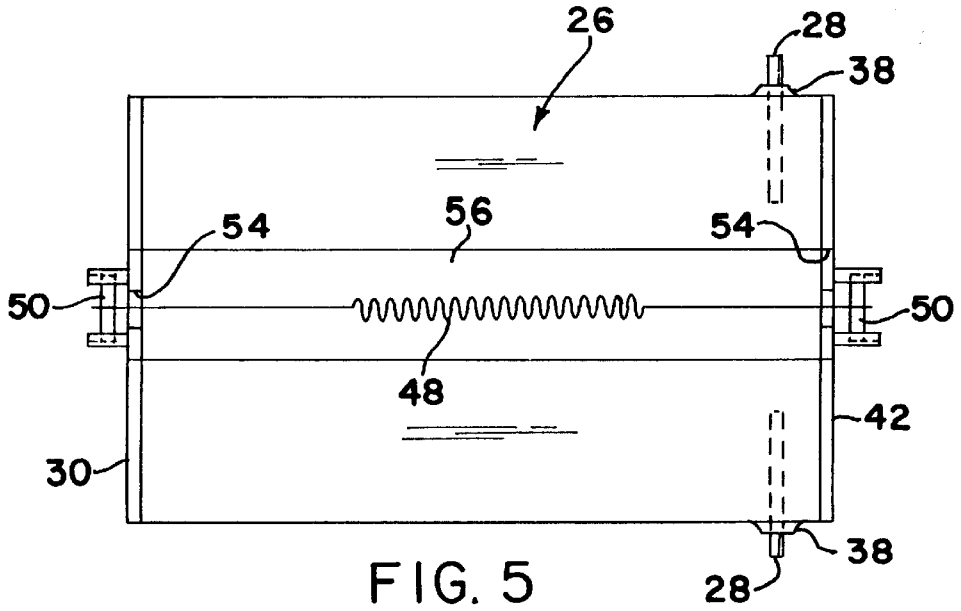
FIG. 5 is a bottom view of the FIG. 4 container for the fire suppressant material.
Figure 6:
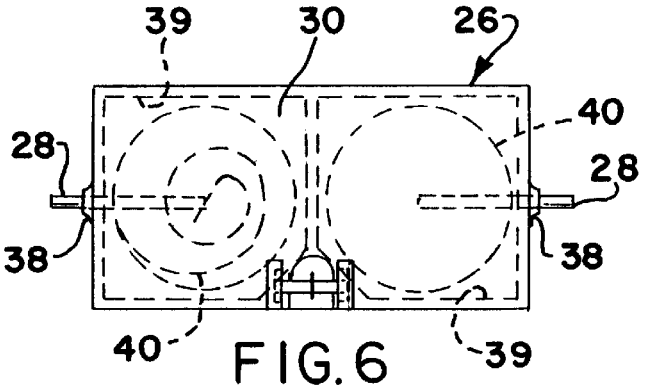
FIG. 6 is a left end view of the container of FIG. 4 showing the relationship of a pair of compression springs to a pair of chambers of the container.
Figure 7:
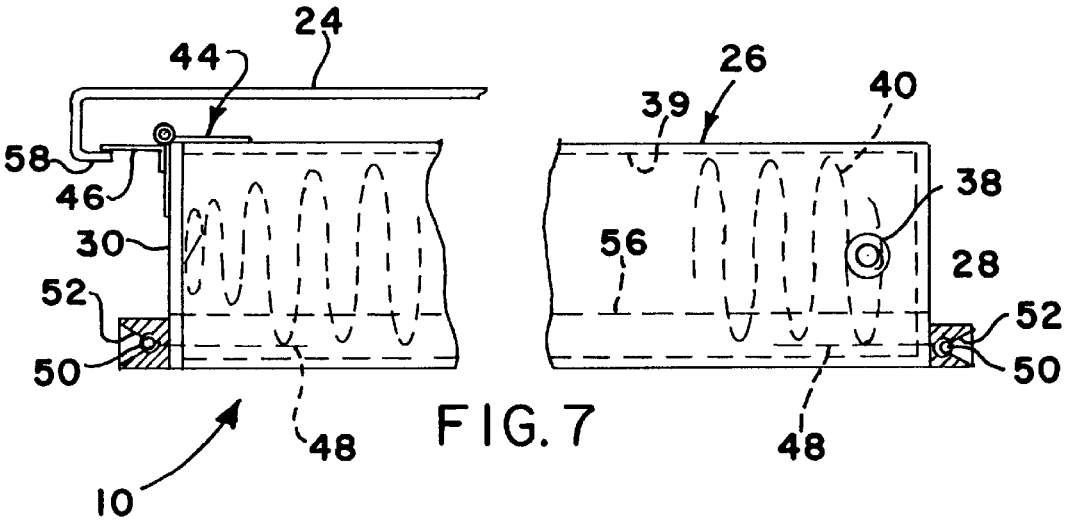
FIG. 7 is a side view of the container looking from the right of FIG. 6.

Both chambers are covered by the cap 30 when in normal "at rest" condition. Any kind of conventional seal can be used to make an air-tight seal between the cap and chambers, but since the design of such a seal would be obvious, it is not being illustrated or described herein. The cap 30 is made pivotable by use of any type hinge 44 having one portion fixed to the container 26 and the other movable with the cap 30. The portion connected to the cap has a latching member 46 extending at a right angle thereto. A tension spring 48 maintains the cap 30 in the closed and sealed condition against the force of the compression helical springs 40 until such time as a grease or oil fire creates sufficient heat to melt either one of a pair of fusible pins 50 encirled by loops at the ends of the spring 48. Each pin 50 is arranged to seat at the bottom of a pair of tapered grooves 52 on protrusions extending outwardly from the cap 30. An opening 54 is aligned with the spring 48 when the spring is assembled to the container 26. An elongated inverted "V" groove 56 is provided for the full length of the underside of the container 26 as can be seen more clearly in FIG. 5. Also as seen in FIGS. 5 and 7, the seating arrangement for the fusible pins 50 and the passage openings 54 are duplicated at both ends of the container 26. The fusible pins 50 can be of any common material used for melting at any appropriate temperature associated with grease fires. Since this is commonly understood in the art, it is not described in any detail as to the exact fusible material or the exact pin dimensions for melting in response to a stovetop fire. Nor do I wish to limit myself to the exact design of the fusible element or spring attachment, since persons skilled in this art will readily see alternative designs which will release the latching member 46 to perform its necessary function about to be described.

Referring more particularly to FIG. 7, the action of releasing the container 26 to swing down and open the cap 30 for fire extinguishing is best described in connection with that Figure. The container 26 is held in the horizontal position by latching member 46 resting upon a fixed latching member or ledge 58. At that time, the spring 48 is under enough tension to counteract the combined force of the pair of helical compression springs 40 as well as the weight of the container 26, both of which tend toward opening of the cap 30. If a fire melts either one of pins 50 at opposite ends of the container 26, spring 48 relaxes to its original state. When this occurs, the compressive force of springs 40 and the weight of the container 26 causes cap 30 to pivot clockwise about its hinge 44. As this happens latching member 46 falls away from ledge 58, the unit is permitted to swing down about trunnions 28, and the powder is dispensed into and around the burning vessel or vessels as mentioned previously in connection with FIG. 1.

The expansion and flopping action of the springs 40 assists in the breaking up of any powder that has tended to pack and to distribute the powder by oscillation of the free end of the springs in an orbital type motion as the springs flop freely. The wire gauge and temper of the springs is such as to provide the necessary compression to force open the cap 30, assist in dispensing the powder and provide some measure of lateral distribution of the powder. The springs 40 are volute, with their smaller diameter ends being the free ends. In addition, the free ends may have a short length extending across the springs to help break up any powder which may have packed and to also control flow. Obviously, and as is described in my parent patent, granular material may also be provided with the powder to inhibit any tendency toward packing.

FIG. 9 shows a mounting plate 55 for receiving one or both ends of rods 22, depending on whether a ledge 21 is present on the hood 20 or whether the rods are perpendicular or angled with respect to wall 18 as shown in FIGS. 2 and 3. If angled as in FIG. 3 to align with angled burners, two plates 55 are required. The plates 55 are slotted as shown in FIG. 9 to accommodate the angular mounting. Plates 55 may be secured to a surface by a central screw and double-sided pressure-sensitive adhesive tape.

An alternative embodiment is shown in FIGS. 11 and 12. This I will designate a two-stage design, as compared to the single stage pendulum swinging design described above. By two-stage, I mean that the first occurrence is a heat or flame responsive action in which a first latching operation releases the unit to move from the horizontal position into a vertical position. Almost immediately after that, a second heat or flame responsive action occurs, opening the cap to dispense fire suppressant material by gravity. Each embodiment has its advantages, the two-stage system waiting to dispense its powder until after the unit is already vertical, at which time it is closer to the burning oil. It requires a smaller volume of powder, but is capable of extinguishing a fire on only one burner, as compared to the single-stage unit with it pendulum action allowing a single unit to cover two burners. The two stage unit may require but a single chamber of powder.

FIG. 11 shows the two-stage unit from its side, it being understood that I may also mount its bracket 60*a* by means of spring-loaded rods such as 22. For this unit, a pair of heat-responsive nylon filaments 62 and 64 are shown as being the fusible elements, but other fusible materials may be used in their place. Filament 62 is connected at its right end to a depending leg 66 of bracket 60*a* and at it right end to a tension spring 68. Spring 68 has its opposite end connected to a leg 70 of the bracket 60*a*. When filament 62 melts, a container 72 is allowed to pivot downwardly by gravity to the vertical position shown in dotted lines, but at the time, its cap 74 remains closed. Filament 64, shown also from beneath in FIG. 12, is anchored at its right end to a tension spring 65, which in turn is connected to the container 72. A plate 75 covers the recess in which spring 65 is mounted, and acts as a heat shield. At its left end, filament 64 passes in a loop through a slot 76 in a screw 73 mounted in an extension 76 depending from the cap 74. As soon as the container becomes vertical, a portion of the filament 64 exposed between the extension 76 and the head of the screw 73 is closer to the heat of the flame and burns or melts. At that time, a compression spring exactly like springs 40 (but not depicted in this embodiment) expand to force the cap 74 open and dispense the fire suppressant material. Obviously, the two filaments 62 and 64 are designed to be effective in response to the flame at different temperatures. This is controllable by utilizing different filament materials or different gauge diameters of the same material.

In place of the filament 62 and spring 68, it may be convenient to utilize a bimetal element 78 to act as a movable ledge similar to ledge 58 of the single-stage version of FIG. 4. This is shown in FIGS. 13 and 14. The element 78 forming the ledge crosses horizontally between a pair of spaced legs 80 extending downwardly from the bracket 60*b*. One end of the element 78 is fixed to one of the legs 80 and the opposing end is slidable relative to the other leg to allow for expansion and contraction of the bimetal element 78. The element 78 is heat responsive rather that flame responsive as is a meltable filament. It can be set to flex sufficiently to cause the ledge to come free of a latching member 82 similar to member 46 of the earlier-described embodiment. This can be made to occur at a temperature of about 100–105 degrees F., for example. The action of this embodiment can vary from that of the FIGS. 11 and 12 embodiment, depending on whether the filament 64 melts before or after the bimetal element releases the latching member 82. If filament 64 melts first, the cap 74 will be opened by the spring 40 and the latching member 82 will fall away from the element 78 as in the single-stage version of my invention. If the bimetal element 78 releases the latching member 82 prior to filament 64 melting, the container will swing down to its vertical position as in FIG. 11, and the cap 74 can open only after the filament 64 melts.

Various changes can be made in the structure and its operation without departing from the spirit and scope of the claims.

Having described my invention, I claim:

1. In an extinguisher and mounting structure for a stove grease fire, the combination of:

an elongated container for containing a supply of powdered fire suppressant material in a volume sufficient to extinguish such a fire and minimize the potential for reignition;

a closure for one end of said elongated container;

a supporting member for mounting said container essentially horizontally above a burner of said stove and being sufficiently removed from said burner whereby not to interfere with cooking activities related to a fat-containing cooking utensil on said burner;

a mount for pivotally supporting said container from said supporting member adjacent an end thereof remote from said closure end;

a latching member for securing said container in an inoperative horizontal position on said supporting member;

a heat-responsive member for releasing said latching member and enabling pivotal movement of said container toward a fire extinguishing essentially vertical position upon being heated to a temperature indicative of an existing grease fire therebelow; and said closure comprising a cap which opens said one end of the container when in said fire extinguishing position, thereby enabling fire suppressant material to be dispensed primarily by gravity into said cooking utensil.

2. The invention according to claim 1 wherein said latching member for securing said container in its inoperative position prevents opening said cap until said latching member releases said container.

3. The invention according to claim 1 wherein said latching member comprises a first latching member, wherein a second latching member responsive to heat maintains said cap in its closed condition independently of said first latching member and wherein said second latching member is heat-activated to open said closure after said first latching member has released said container to enable its movement toward its fire extinguishing position.

4. The invention according to claim 1 wherein said mount comprises a pair of trunions positioned on a horizontal axis and extending outwardly from opposed sides of said container, and wherein said container and said trunnions are so weighted and positioned as to result in a free-swinging pendulum motion of said container about said horizontal trunnion axis while said fire suppressant material is being dispensed from said container.

5. The invention according to claim 4 wherein said supporting member comprises a supporting bracket having a pair of depending legs which provide journals for said trunnions.

6. The invention according to claim 5 wherein said bracket extends essentially the length of said container and has a pair of spaced bracket extensions on each side thereof at opposite ends of said bracket, each said pair of bracket extensions including horizontally-aligned rod-receptive openings, and a pair of support rods passing through said rod-receptive openings at opposite sides of said container for mounting said bracket and container above said stove.

7. The invention according to claim 6 wherein said stove has a hood thereover extending essentially front-to-back and side-to-side over said stove, first support means for said pair of support rods at the front of said hood and second support means at the back of said hood, at least the second support means providing a mounting plate having a pair of holes therein for receiving the ends of said rods adjacent the back of said hood.

8. The invention according to claim 7 wherein each of said support rods comprises a pair of telescoping elements each having a combined length exceeding the front-to-back dimensions of said hood, each said element having a compression spring intermediate the elements whereby to provide an outwardly-directed force enabling said support rods, supporting bracket and container to be mounted over and dismounted from said hood without the use of tools.

9. The invention according to claim 1 wherein said container consists of at least one elongated chamber, and wherein a helical compression spring is mounted within said at least one elongated chamber and has a first end anchored in said at least one elongated chamber at the end remote from the closure and a second free end, said spring, when released, having a length at least 30% greater than the internal portion of the at least one elongated chamber.

10. The invention according to claim 9 wherein the wire gauge of said helical spring is tempered to enable said spring to have a measure of floppiness when said cap is opened, whereby flopping of the free end of the extended spring assists in a small degree of lateral distribution of the powdered fire suppressant material as it is dispensed.

11. The invention according to claim 10 wherein the helical spring is also a volute spring having a reduced-diameter free end for breaking up any powdered fire suppressant material which may have tended to pack within the container while in the inoperative position.

12. The invention according to claim 1 wherein said cap is horizontally hinged to said container at the top thereof wherein said latching member comprises a first portion fixed to said cap and a second portion fixed to said container, whereby said heat-responsive member, when enabling said cap to be opened, enables the first portion of the latching member to fall away from the second portion thereof and the container to pivot toward its fire extinguishing position.

13. The invention according to claim 12 wherein the stove has a pair of front-to-back aligned burners and wherein the pivotal supporting mount for said container enables a free-swinging pendulum action of the container between the pair of burners, thereby extinguishing a fire on either or both of said burners.

14. The invention according to claim 13 wherein said burners are aligned at an angle relative to the front of said stove, and said supporting member further includes a pair of support rods supporting said container in its inoperative horizontal position at the same angle as said burner angle.

15. The invention according to claim 13 wherein said container consists of at least one elongated chamber, and wherein a helical compression spring is mounted within said at least one elongated chamber and has a first end anchored in said at least one elongated chamber at the end remote from the closure and a second free end, said spring, when released, having a length at least 30% greater than the internal portion of the at least one elongated chamber.

16. The invention according to claim 15 wherein the wire gauge of said helical spring is tempered to enable said spring to have a measure of floppiness when said cap is opened, whereby flopping of the free end of the extended spring assists in lateral distribution of the powdered fire suppressant material as it is dispensed.

17. A supporting member and mounting plate for mounting an extinguisher for a grease fire in a hood over a stove, which extinguisher is responsive to automatic release of a fire suppressant material into a cooking utensil on a burner of said stove upon flame-up of grease in said utensil; said combination comprising:

said supporting member comprising a pair of horizontally-spaced parallel telescoping rods straddling and mounting said extinguisher beneath and within said hood;

said hood comprising a frontal portion facing an individual who is cooking at said stove, and further including an inwardly-directed horizontal lip at a bottom horizontal edge of said frontal portion;

said mounting plate being secured at a rear portion of said hood horizontally opposite and at the same general level as said hood lip;

said mounting plate having a pair of rod-receiving openings and being mountable in opposition to said lip with the bottoms of said openings being essentially at the same level as said lip;

a compression spring associated with each said rod and extending said telescoping rods to a length exceeding the front-to-back distance of the inside of said hood frontal portion to said mounting plate; and said springs, when compressed, providing an outwardly-directed force between said rod-receiving openings and the inside of said hood frontal portion, the ends of said rods contacting the inside of said hood frontal portion and resting upon said lip whereby to support the extinguisher at the front of said stove while the opposite ends of said rods are supported by said mounting plate.

18. The invention according to claim 17 wherein the stove has a pair of front-to-back burners aligned at an angle relative to the front of said stove, wherein said rods are positioned at the same angle over said burners, and wherein said mounting plate has at least one elongated hole therein for accommodating the angle at which said rods are positioned.

* * * * *